US012551039B2

(12) United States Patent
Liu et al.

(10) Patent No.: US 12,551,039 B2
(45) Date of Patent: Feb. 17, 2026

(54) BUOYANCY-TYPE PILLOW WITH COMBINED ACTION OF GAS AND LIQUID MEDIA

(71) Applicant: Shanghai BackRobo Wellness Co., Ltd., Shanghai (CN)

(72) Inventors: Wenchao Liu, Shanghai (CN); Qiao Zhao, Shanghai (CN); Jichang Du, Shanghai (CN)

(73) Assignee: Shanghai BackRobo Wellness Co., Ltd., Shanghai (CN)

( * ) Notice: Subject to any disclaimer, the term of this patent is extended or adjusted under 35 U.S.C. 154(b) by 28 days.

(21) Appl. No.: 18/395,730

(22) Filed: Dec. 25, 2023

(65) Prior Publication Data

US 2025/0031879 A1 Jan. 30, 2025

(51) Int. Cl.
*A47G 9/10* (2006.01)

(52) U.S. Cl.
CPC ..... *A47G 9/1027* (2013.01); *A47G 9/1036* (2013.01); *A47G 9/1081* (2013.01)

(58) Field of Classification Search
CPC .. A47G 9/1027; A47G 9/10; A47G 2009/003; A47G 2009/1018; A47G 9/0253; A47G 9/1081; A47G 2009/008; A47G 9/109; A47G 9/1036; A47C 27/081; A47C 7/383; A47C 16/00; A47C 27/084; A45F 2004/026; A45F 4/02; A45F 4/06
USPC ..... 5/644, 636, 655.5, 708
See application file for complete search history.

(56) References Cited

U.S. PATENT DOCUMENTS 6,951,038 B1 * 10/2005 Ganoe, Sr. ..... A47G 9/1027 5/636
2006/0123548 A1 * 6/2006 Heath ..... A47G 9/10 5/655.5
2013/0269111 A1 * 10/2013 Berg ..... A47G 9/1027 112/475.08
2019/0059620 A1 * 2/2019 Gosse ..... A47G 9/1081

FOREIGN PATENT DOCUMENTS

JP 2002238716 A * 8/2002

* cited by examiner

*Primary Examiner* — Madison Emanski
(74) *Attorney, Agent, or Firm* — IPRTOP LLC

(57) ABSTRACT

A buoyancy-type pillow with a combined action of gas and liquid media is provided. The pillow includes a first pillow body, a second pillow body stacked on a top of the first pillow body, and an interlayer support pad located in an inner cavity of the second bladder. The first pillow body includes a first bladder having a flat shape, the inner cavity of the first bladder is filled with gas medium, and the first bladder is provided with a gas volume adjustment interface. The second pillow body includes a second bladder having a flat shape, the inner cavity of the second bladder is filled with liquid medium, and the second bladder is provided with a liquid volume adjustment interface. The interlayer support pad has a porous structure that allows the liquid medium to flow through. The disclosure achieves an all-around buoyancy support effect.

10 Claims, 3 Drawing Sheets

BUOYANCY-TYPE PILLOW WITH COMBINED ACTION OF GAS AND LIQUID MEDIA

TECHNICAL FIELD

The present disclosure relates to the technical field of pillows, particularly to a buoyancy-type pillow with a combined action of gas and liquid media.

BACKGROUND

Modern life is stressful, and the quality of sleep directly affects physical health. Therefore, people generally use pillows to support their heads during sleep, keeping the head and body in a balanced state to prevent excessive stretching or contraction of the neck and shoulder muscles. Hence, a pillow should be able to support the head, neck, and shoulders to allow the body to get proper rest and achieve good quality sleep.

The pillows available on the market are mostly filled with cotton padding, and the height and elasticity of these pillows depend on the amount of filling. Especially since everyone's body shape and habitual sleeping position are different, for example, when sleeping on the side, there is a larger gap between the side shoulder and the neck, and this area requires higher support to prevent issues like a stiff neck from occurring.

Gradually, the cotton filling inside the aforementioned pillow tends to lose its fluffiness, making it harder for heat and moisture to dissipate, which can easily lead to the growth of mold, dust mites, and other allergens within the cotton. Additionally, long-term use of a deformed pillow with poor curvature can cause the user to experience a curved cervical spine and back pain.

To address the aforementioned shortcomings, there is another type of pillow available on the market that uses elastic materials such as foam or latex. Although these materials offer better resilience compared to cotton filling materials and can provide stable support for the head and neck, they do have fixed height and elasticity. Consequently, users cannot adjust the pillow's height and elasticity to suit their individual preferences and sleeping habits.

An existing patent (application number: CN201910447583.5) discloses an adaptive intelligent comfort pillow, which has the following disadvantages: the head support device (2) is set above the water bag (8), and this arrangement still cannot make the head support device (2) fit the user's head and neck.

SUMMARY

The present disclosure provides a buoyancy-type pillow with a combined action of gas and liquid media, ensuring the free flow of liquid within the second bladder during the user's sleep and rest, forming a shape that adapts to the head and neck to achieve an all-around buoyancy support effect, and can combine the support force of the gas to more effectively improve sleep comfort.

The buoyancy-type pillow with a combined action of gas and liquid media includes a first pillow body, a second pillow body stacked on a top of the first pillow body, and an interlayer support pad located in an inner cavity of the second bladder. The first pillow body includes a first bladder having a flat shape; an inner cavity of the first bladder is filled with gas medium; the first bladder is provided with a gas volume adjustment interface, and the gas volume adjustment interface is configured to fill the first bladder with the gas medium or to discharge the gas medium from the first bladder. The second pillow body includes a second bladder having a flat shape; the inner cavity of the second bladder is filled with liquid medium; the second bladder is provided with a liquid volume adjustment interface, and the liquid volume adjustment interface is configured to fill the second bladder with the liquid medium or to discharge the liquid medium from the second bladder. The interlayer support pad has a porous structure that allows the liquid medium to flow through; the interlayer support pad is configured to undergo compressive deformation to release the liquid medium when a user's head and neck press against the second pillow, and to return to an original shape of the interlayer support pad to absorb the liquid medium when the user's head and neck are away from the second pillow.

Preferably, the second bladder includes a second bottom layer and a second top layer; the second bottom layer abuts against the first bladder; the second top layer has an uneven undulating area, and the uneven undulating area is configured to fit the user's head and neck.

Preferably, the interlayer support pad is a sponge pad or a thick cloth pad.

Preferably, the buoyancy-type pillow with the combined action of gas and liquid media further includes a medium filling and releasing device connected to the first bladder and/or the second bladder.

Preferably, the medium filling and releasing device includes a liquid storage tank, a liquid suction and discharge pump, a gas suction and discharge pump, a liquid transfer tube, and a gas transfer tube; the liquid storage tank, the liquid suction and discharge pump, the liquid transfer tube, and the second bladder are connected in sequence; the gas suction and discharge pump, the gas transfer tube, and the first bladder are connected in sequence.

Preferably, the medium filling and releasing device includes a liquid storage tank, a liquid suction and discharge pump, a liquid transfer tube, a thermometer, and a heating and cooling module; the liquid storage tank, the liquid suction and discharge pump, the liquid transfer tube, and the second bladder are connected in sequence; the thermometer is communicatively connected to the heating and cooling module to feedback temperature information of the liquid medium to the heating and cooling module, wherein the heating and cooling module is configured to adjust a temperature of the liquid medium.

Preferably, the second bladder includes a second bottom layer and a second top layer; the second bottom layer and the second top layer are connected with each other through a positioning connection structure; the interlayer support pad is provided with a positioning hole, with an edge of the positioning hole avoiding contact with the positioning connection structure.

Preferably, the interlayer support pad is provided with a plurality of positioning holes located at edges of the interlayer support pad; a plurality of positioning connection structures is provided, and the plurality of positioning connection structures is located at edges of the second bladder, with each of the plurality of positioning connection structures corresponding one-to-one with one of the plurality of positioning holes; the second top layer forms an uneven undulating area when each of the plurality of positioning connection structures passes through a corresponding positioning hole.

Preferably, the positioning connection structure is a riveting structure or a snap-fit component.

Preferably, the second bladder includes a second bottom layer and a second top layer, and the second top layer has multiple hemispherical protrusions.

As described above, the buoyancy-type pillow with the combined action of gas and liquid media of the present disclosure has the following advantages. The buoyancy-type pillow of the present disclosure combines a water layer structure and an air layer structure. The water layer structure uses an uneven soft area to provide a comfortable sleeping sensation similar to floating on water, while the air layer structure provides sufficient support underneath. Since the liquid medium is fluid and has no fixed shape, when the liquid medium flows into the inner cavity of the second bladder, it can move to any part of the inner cavity of the second bladder, allowing the second bladder to adaptively deform according to the shape and size of the user's head and neck, thereby providing better comfort. It can fully conform to the user's head and neck, allowing them to achieve the sensation of floating on water. Users can also inject an appropriate amount of liquid through the liquid volume adjustment interface according to their own needs to find the most suitable buoyancy for themselves. The first bladder underneath can provide support for the entire pillow, and its gas volume can also be freely adjusted by the user through the gas volume adjustment interface to find the suitable height and firmness. More importantly, the innovation of the present disclosure lies in: the interlayer support pad is located in the inner cavity of the second bladder, and the interlayer support pad has a porous structure that allows the liquid medium to flow through. The interlayer support pad undergoes compressive deformation to release the liquid medium when the user's head and neck press on the second pillow, and it returns to its original shape to absorb the liquid medium when the user's head and neck are away from the second pillow. With such a setup, the interlayer support pad can provide auxiliary support, preventing the upper and lower surfaces of the second bladder from being pressed together, always maintaining the fluidity of the liquid inside the second bladder, thus effectively supporting the user's head and neck. Therefore, the buoyancy-type pillow with the combined action of gas and liquid media of the present disclosure can ensure the free flow of liquid inside the second bladder during the user's sleep and rest, forming a shape adapted to the head and neck to achieve an all-around buoyancy support effect, and can combine the support force of the gas to more effectively improve the comfort of sleep.

Figure 1:
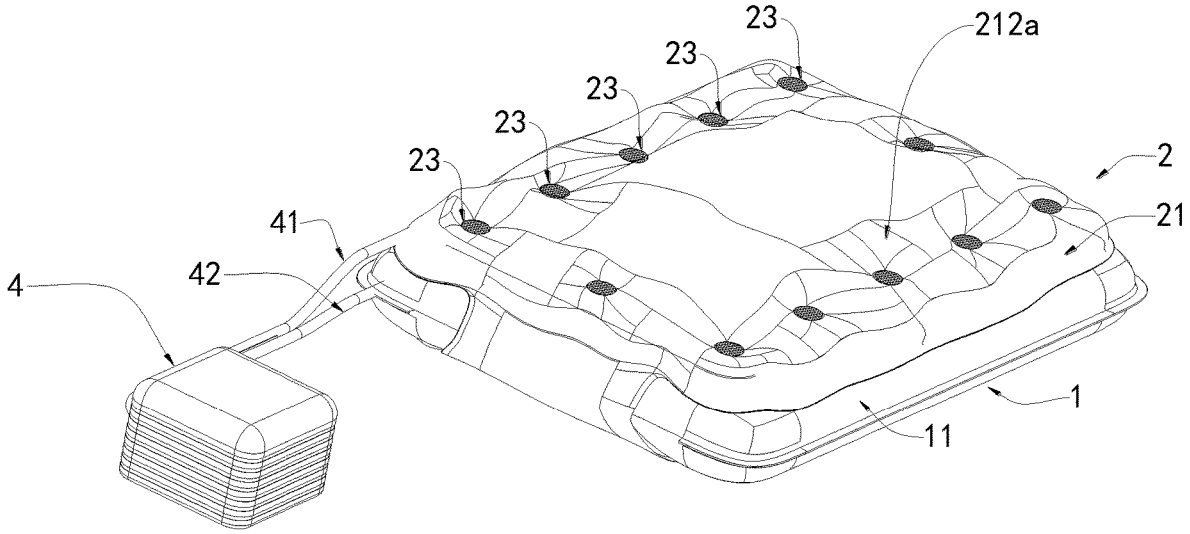
FIG. 1 shows a perspective view of a buoyancy-type pillow with a combined action of gas and liquid media according to the present disclosure.
Figure 2:
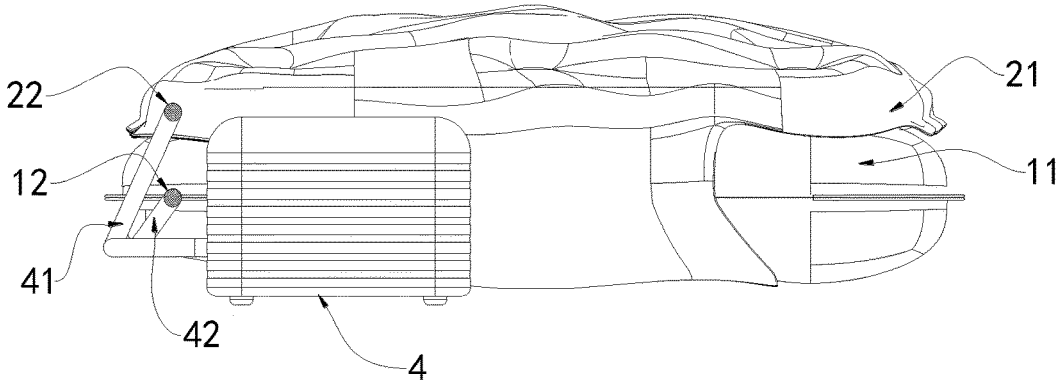
FIG. 2 shows a side view of the buoyancy-type pillow with the combined action of gas and liquid media according to the present disclosure.

| Component reference numerals | |
|---|---|
| 1 | First pillow body |
| 11 | First bladder |
| 12 | Gas volume adjustment interface |
| 2 | Second pillow body |
| 21 | Second bladder |
| 211 | Second bottom layer |
| 212 | Second top layer |
| 212a | Uneven undulating area |
| 212b | Hemispherical protrusion |
| 22 | Liquid volume adjustment interface |
| 23 | Positioning connection structure |
| 231 | Riveting point |
| 232 | Buckle component |
| 3 | Interlayer support pad |
| 31 | Positioning hole |
| 4 | Medium filling and releasing device |
| 41 | Liquid transfer tube |
| 42 | Gas transfer tube |

DETAILED DESCRIPTION

The embodiments of the present disclosure will be described below through exemplary embodiments. Those skilled in the art can easily understand other advantages and effects of the present disclosure according to contents disclosed by the specification.

It should be understood that the structures, proportions, sizes, and the like, which are illustrated in the drawings, are used to clarify the content disclosed in the specification for understanding and reading by those skilled, and are not intended to limit the implementation of the present disclosure. Any modification of the structure, change of the scale, or adjustment of the size should still fall within the scope of the technical content disclosed by the present disclosure without affecting the effects and achievable objectives of the present disclosure. In the meantime, the terms "top", "bottom", "left", "right", "middle" and "one" as used in this specification are also for convenience of description, and are not intended to limit the scope of the present disclosure, and the change or adjustment of the relative relationship is considered to be within the scope of the present disclosure without substantial changes in technology.

As shown in FIGS. 1-2 and 4-6, in order to solve the above technical problems, the present disclosure provides a buoyancy-type pillow with a combined action of gas and liquid media, including a first pillow body 1, a second pillow body 2, and an interlayer support pad 3.

The first pillow body 1 comprises a first bladder 11 having a flat shape, an inner cavity of the first bladder 11 is filled with gas medium, and the first bladder 11 is provided with a gas volume adjustment interface 12, which is used to fill the first bladder 11 with the gas medium or to discharge the gas medium from the first bladder 11.

The second pillow body 2 is stacked on a top of the first pillow body 1. The second pillow body 2 includes a second bladder 21 having a flat shape. An inner cavity of the second bladder 21 is filled with liquid medium. The second bladder 21 is provided with a liquid volume adjustment interface 22, which is used to fill the second bladder 21 with the liquid medium or to discharge the liquid medium from the second bladder 21.

The interlayer support pad 3 is disposed in the inner cavity of the second bladder 21. The interlayer support pad 3 has a porous structure that allows the liquid medium to flow through. The interlayer support pad 3 undergoes compressive deformation to release the liquid medium when the user's head and neck press against the second pillow body 2. The interlayer support pad 3 returns to its original shape to absorb the liquid medium when the user's head and neck are away from the second pillow body 2.

The buoyancy-type pillow of the present disclosure combines a water layer structure and an air layer structure. The water layer structure uses uneven soft areas to provide a comfortable sleeping sensation similar to floating on water, while the air layer structure provides sufficient support underneath. Since the liquid medium (such as tap water) is fluid and has no fixed shape, when the liquid medium flows into the inner cavity of the second bladder 21, it can move to any part of the inner cavity of the second bladder 21. This allows the second bladder 21 to adaptively deform according to the shape and size of the user's head and neck, thereby providing better comfort. It can fully conform to the user's head and neck, allowing them to achieve the sensation of floating on water. Users can also fill in an appropriate amount of liquid through the liquid volume adjustment interface 22 according to their own needs, to find the most suitable buoyancy for themselves. The first bladder 11 below the second pillow body 2 can provide support for the entire pillow, and its gas volume can also be freely adjusted by the user through the gas volume adjustment interface 12, to find the suitable height and firmness for themselves.

What is more important is that the interlayer support pad 3 is located in the inner cavity of the second bladder 21, and the interlayer support pad 3 has a porous structure that allows the liquid medium to flow through. The interlayer support pad 3 undergoes compressive deformation to release the liquid medium when the user's head and neck press against the second pillow body 2, and the interlayer support pad 3 returns to its original shape to absorb the liquid medium when the user's head and neck are away from the second pillow body 2. With such a setup, the interlayer support pad 3 can provide auxiliary support force, and it can prevent the upper and lower surfaces of the second bladder 21 from being pressed together, always maintaining the fluidity of the liquid inside the second bladder 21, thus enabling the liquid to effectively support the user's head and neck.

Therefore, the buoyancy-type pillow with the combined action of gas and liquid media of the present disclosure can ensure the free flow of the liquid in the second bladder 21 when the user is sleeping and resting, forming a shape adapted to the head and neck to achieve an all-round buoyancy support effect, and can combine the support force of the gas to more effectively improve the comfort of sleep.

Additionally, compared to pure latex and sponge pillows of the same volume, most of the filling in the pillow of the present disclosure can be air and water, significantly reducing the use of chemical materials, which is not only more environmentally friendly but also reduces the shipping volume.

The first pillow body 1 and the second pillow body 2 can be fixedly connected to each other, connected by Velcro, or connected by electrostatic adsorption.

To make the second bladder 21 fit the user's head and neck more closely, the second bladder 21 includes a second bottom layer 211 and a second top layer 212. The second bottom layer 211 abuts against the first bladder 11. The second top layer 212 has an uneven undulating area 212*a*, and the uneven undulating area 212*a* fits the user's head and neck.

To reduce production costs, the interlayer support pad 3 is a sponge pad or a thick cloth pad.

To facilitate the adjustment of the gas volume or liquid volume, the buoyancy-type pillow with the combined action of gas and liquid media further includes a medium filling and releasing device 4, which can be manual or electric. The medium filling and releasing device 4 is connected to the first bladder 11 and/or the second bladder 21 through a transfer tube. The medium filling and releasing device 4 can be set separately from the first pillow body 1 and the second pillow body 2, or it can be integrated on one side of the first pillow body 1 and the second pillow body 2.

In some embodiments, the medium filling and releasing device 4 includes a liquid storage tank, a liquid suction and discharge pump, a gas suction and discharge pump, a liquid transfer tube 41, and a gas transfer tube 42. The liquid storage tank, the liquid suction and discharge pump, the liquid transfer tube 41, and the second bladder 21 are connected in sequence. The gas suction and discharge pump, the gas transfer tube 42, and the first bladder 11 are connected in sequence. The medium filling and releasing device 4 also includes a casing, which is used to accommodate the liquid storage tank, the liquid suction and discharge pump, and the gas suction and discharge pump. For example, the liquid transfer tube 41 is connected to the second bladder 21 through the liquid volume adjustment interface 22, and the gas transfer tube 42 is connected to the first bladder 11 through the gas volume adjustment interface 12.

In some embodiments, to improve the comfort brought by temperature, the medium filling and releasing device 4 includes a liquid storage tank, a liquid suction and discharge pump, a liquid transfer tube 41, a thermometer, and a heating and cooling module. The liquid storage tank, the liquid suction and discharge pump, the liquid transfer tube 41, and the second bladder 21 are connected in sequence. The thermometer is communicatively connected to the heating and cooling module to feedback the temperature information of the liquid medium to the heating and cooling module. The heating and cooling module can adjust the temperature of the liquid medium.

Figure 4:
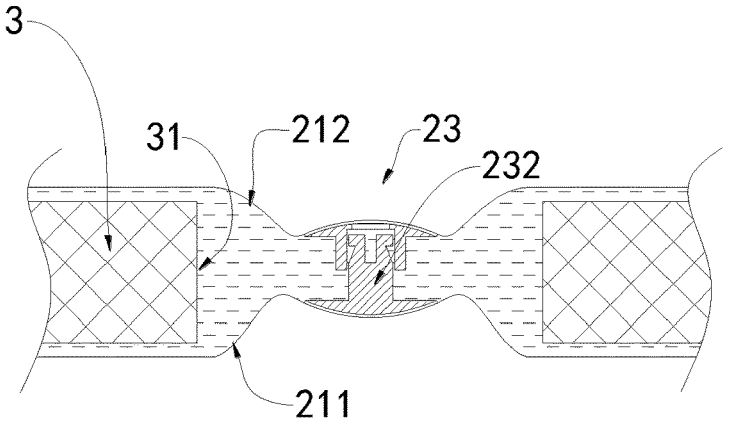
FIG. 4 shows a cross-sectional view of a first embodiment of the second bladder.
Figure 5:
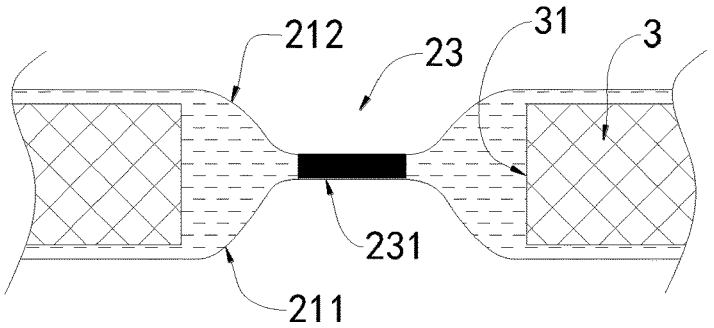
FIG. 5 shows a cross-sectional view of a second embodiment of the second bladder.

As shown in FIGS. 4 and 5, in order to prevent the interlayer support pad 3 from moving within the second bladder 21, the second bladder 21 includes a second bottom layer 211 and a second top layer 212, with the second bottom layer 211 and the second top layer 212 being connected with each other by a positioning connection structure 23. The interlayer support pad 3 is provided with a positioning hole 31, with an edge of the positioning hole 31 avoiding contact with the positioning connection structure 23.

To enhance the softness and fit of the top surface of the second bladder 21, the interlayer support pad 3 is provided with multiple positioning holes 31, with all the positioning holes 31 located at the edges of the interlayer support pad 3; multiple positioning connection structures 23 may be provided, with all the positioning connection structures 23 located at the edges of the second bladder 21, and each of the positioning connection structures 23 corresponds one-to-one with one of the positioning holes 31. The second top layer 212 forms the uneven undulating area 212*a* when each positioning connection structure 23 passes through the corresponding positioning hole 31.

Figure 3:
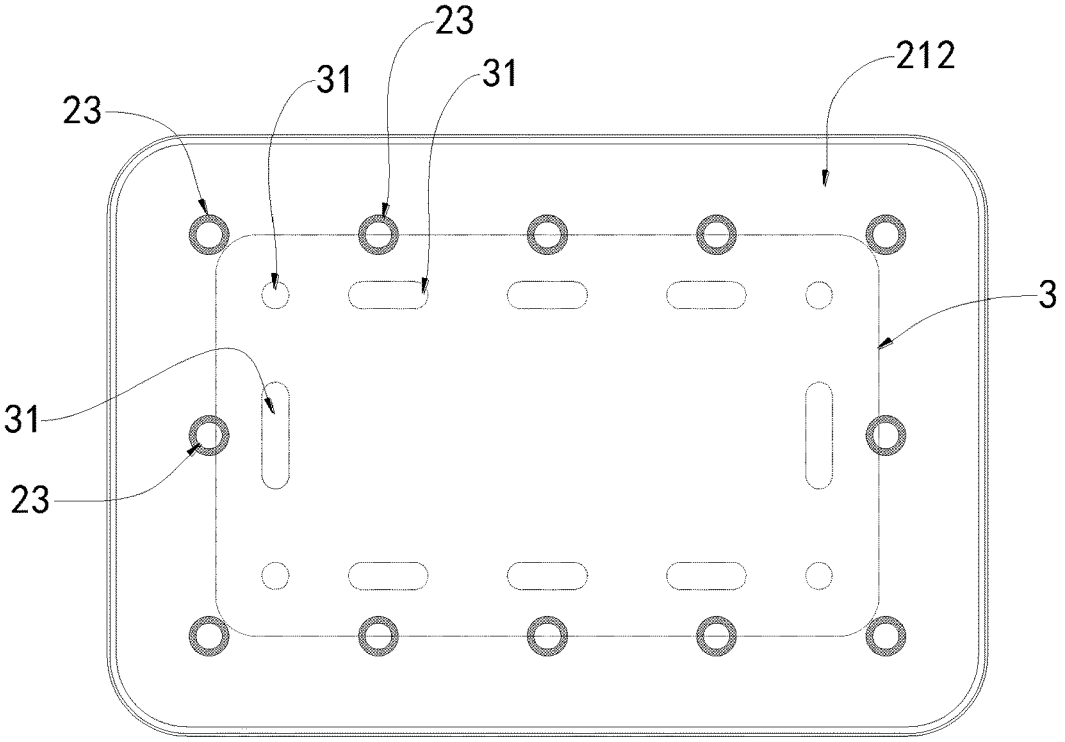
FIG. 3 shows a top view of a second bladder when positioning connection structures do not pass through positioning holes.

As shown in FIG. 3, the second bladder 21 is in a flat state, at which time, each positioning connection structure 23 is located on the outside of the corresponding positioning hole 31; that is to say, when each positioning connection structure 23 passes through the corresponding positioning hole 31, most areas of the second top layer 212 will be in a loose state, at this time forming the uneven undulating area 212*a*.

In an example, referring to FIG. 5, as a first embodiment of the second bladder 21, the second bladder 21 has two layers of leather material, with several riveting points 231 set on the two layers of leather material. Between the upper and lower layers of leather material, a moderately sized sponge pad (i.e., the interlayer support pad 3) is placed, with several positioning holes 31 on the sponge pad. These positioning holes 31 are contracted inward relative to the riveting points of the leather material. When the riveting points 231 are riveted through the positioning holes 31, the top surface of the second bladder 21 is brought to a soft state.

In an example, referring to FIG. 4, as a second embodiment of the second bladder 21, the second bladder 21 has two layers of leather material, with several buckle components 232 set on the two layers of leather material. Between the upper and lower layers of leather material, a moderately sized sponge pad (i.e., the interlayer support pad 3) is placed, with several positioning holes 31 on the sponge pad. When the buckle components 232 are fastened through the positioning holes 31, the top surface of the second bladder 21 is brought to a soft state.

Figure 6:
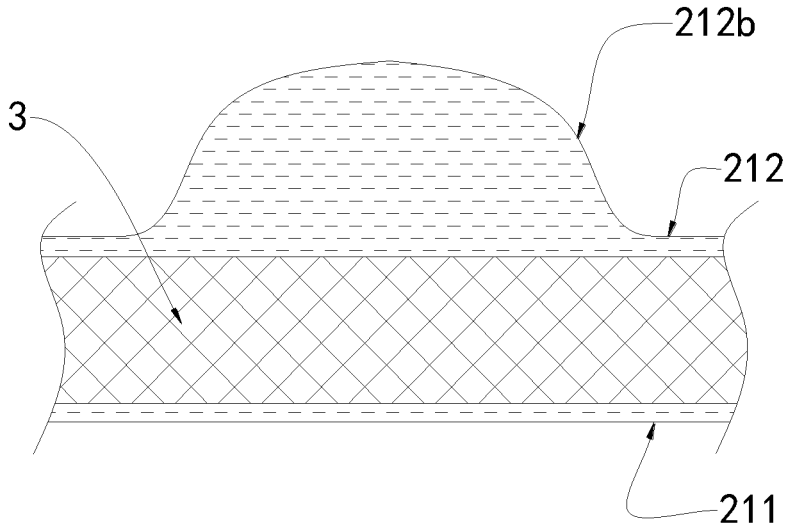
FIG. 6 shows a cross-sectional view of a third embodiment of the second bladder.

In another example, referring to FIG. 6, as a third embodiment of the second bladder body 21, the second bladder body 21 includes a second bottom layer 211 and a second top layer 212, and the second top layer 212 has multiple hemispherical protrusions 212*b*. At this time, the interlayer support pad 3 does not need to have positioning holes 31, which can also make the top surface of the second bladder 21 achieve a soft effect.

In summary, the buoyancy-type pillow with the combined action of gas and liquid media of the present disclosure can ensure the free flow of the liquid inside the second bladder 21 when the user is sleeping and resting, forming a shape that adapts to the head and neck to achieve an all-around buoyancy support effect. Moreover, it can combine the support force of the gas to more effectively improve the comfort of sleep. Therefore, the present disclosure effectively overcomes various shortcomings in the prior art and has high industrial utility value.

The above-mentioned embodiments are just used for exemplarily describing the principle and effects of the present disclosure instead of limiting the present disclosure. Those skilled in the art can make modifications or changes to the above-mentioned embodiments without going against the spirit and the range of the present disclosure. Therefore, all equivalent modifications or changes made by those who have common knowledge in the art without departing from the spirit and technical concept disclosed by the present disclosure shall be still covered by the claims of the present disclosure.

The invention claimed is:

1. A pillow with a combined action of gas and liquid media, comprising:

a first pillow body (1), comprising a first bladder (11) having a flat shape, wherein an inner cavity of the first bladder (11) is filled with gas medium, wherein the first bladder (11) is provided with a gas volume adjustment interface (12), wherein the gas volume adjustment interface (12) is configured to fill the first bladder (11) with the gas medium or to discharge the gas medium from the first bladder (11);

a second pillow body (2) stacked on a top of the first pillow body (1), comprising a second bladder (21) having a flat shape, wherein an inner cavity of the second bladder (21) is filled with liquid medium, wherein the second bladder (21) is provided with a liquid volume adjustment interface (22), wherein the liquid volume adjustment interface (22) is configured to fill the second bladder (21) with the liquid medium or to discharge the liquid medium from the second bladder (21); and an interlayer support pad (3) disposed in the inner cavity of the second bladder (21), wherein the interlayer support pad (3) has a porous structure that allows the liquid medium to flow through, wherein the interlayer support pad (3) is configured to undergo compressive deformation to release the liquid medium when a head and neck of a user press against the second pillow body (2), and to return to an original shape of the interlayer support pad (3) to absorb the liquid medium when the head and neck of the user are away from the second pillow body (2).

2. The pillow with the combined action of gas and liquid media as in claim 1, wherein the second bladder (21) comprises a second bottom layer (211) and a second top layer (212), wherein the second bottom layer (211) abuts against the first bladder (11), wherein the second top layer (212) has an uneven undulating area (212*a*), wherein the uneven undulating area (212*a*) is configured to fit the head and neck of the user.

3. The pillow with the combined action of gas and liquid media as in claim 1, wherein the interlayer support pad (3) is a sponge pad or a thick cloth pad.

4. The pillow with the combined action of gas and liquid media as in claim 1, further comprising a medium filling and releasing device (4) connected to the first bladder (11) and/or the second bladder (21).

5. The pillow with the combined action of gas and liquid media as in claim 4, wherein the medium filling and releasing device (4) comprises a liquid storage tank, a liquid suction and discharge pump, a gas suction and discharge pump, a liquid transfer tube (41), and a gas transfer tube (42);

wherein the liquid storage tank, the liquid suction and discharge pump, the liquid transfer tube (41), and the second bladder (21) are connected in sequence;

wherein the gas suction and discharge pump, the gas transfer tube (42), and the first bladder (11) are connected in sequence.

6. The pillow with the combined action of gas and liquid media as in claim 4, wherein the releasing device (4) comprises a liquid storage tank, a liquid suction and discharge pump, a liquid transfer tube (41), a thermometer, and a heating and cooling module;

wherein the liquid storage tank, the liquid suction and discharge pump, the liquid transfer tube (41), and the second bladder (21) are connected in sequence;

wherein the thermometer is communicatively connected to the heating and cooling module to feedback temperature information of the liquid medium to the heating and cooling module, wherein the heating and cooling module is configured to adjust a temperature of the liquid medium.

7. The pillow with the combined action of gas and liquid media as in claim 1, wherein the second bladder (21) comprises a second bottom layer (211) and a second top layer (212), wherein the second bottom layer (211) and the second top layer (212) are connected with each other through a positioning connection structure (23); wherein the interlayer support pad (3) is provided with a positioning hole (31), with an edge of the positioning hole (31) avoiding contact with the positioning connection structure (23).

8. The pillow with the combined action of gas and liquid media as in claim 7, wherein the interlayer support pad (3) is provided with a plurality of positioning holes (31), wherein the plurality of positioning holes (31) is located at edges of the interlayer support pad (3);

wherein a plurality of positioning connection structures (23) is provided, wherein the plurality of positioning connection structures (23) is located at edges of the second bladder (21), with each of the plurality of positioning connection structures (23) corresponding one-to-one with one of the plurality of positioning holes (31);

wherein the second top layer (212) forms an uneven undulating area (212*a*) when each of the plurality of positioning connection structures (23) passes through a corresponding positioning hole (31).

9. The pillow with the combined action of gas and liquid media as in claim 7, wherein the positioning connection structure (23) is a riveting structure or a snap-fit component.

10. The pillow with the combined action of gas and liquid media as in claim 1, wherein the second bladder (21) comprises a second bottom layer (211) and a second top layer (212), wherein the second top layer (212) has multiple hemispherical protrusions (212*b*).

* * * * *